US010058142B2

(12) United States Patent
Simmons

(10) Patent No.: US 10,058,142 B2
(45) Date of Patent: Aug. 28, 2018

(54) HEADSCARF WITH INTEGRATED HEADBAND

(71) Applicant: Courtney Simmons, Los Angeles, CA (US)

(72) Inventor: Courtney Simmons, Los Angeles, CA (US)

( * ) Notice: Subject to any disclaimer, the term of this patent is extended or adjusted under 35 U.S.C. 154(b) by 74 days.

(21) Appl. No.: 14/825,793

(22) Filed: Aug. 13, 2015

(65) Prior Publication Data

US 2016/0058096 A1 Mar. 3, 2016

Related U.S. Application Data

(60) Provisional application No. 62/044,278, filed on Aug. 31, 2014.

(51) Int. Cl.

| | |
|---|---|
| ***A42B 7/00*** | (2006.01) |
| ***A45D 8/36*** | (2006.01) |
| ***A41D 23/00*** | (2006.01) |

(52) U.S. Cl.

CPC ..... *A42B 7/00* (2013.01); *A41D 23/00* (2013.01); *A45D 8/36* (2013.01)

(58) Field of Classification Search

CPC ..... A42D 7/00; A41D 23/00; A41D 13/1161; A45D 8/36; A45D 2007/002

See application file for complete search history.

(56) References Cited

U.S. PATENT DOCUMENTS

| | | | | | |
|---|---|---|---|---|---|
| 2,005,361 | A | * | 6/1935 | Rollins | A42B 1/066 2/195.1 |
| D109,690 | S | * | 5/1938 | Atwood | D2/500 |
| 2,256,866 | A | * | 9/1941 | Goodall | A42C 5/00 2/175.3 |
| D165,054 | S | * | 11/1951 | Crowthers | 2/207 |
| 2,574,208 | A | | 11/1951 | Crowthers | |
| 2,600,814 | A | * | 6/1952 | Tomarkin | A41D 23/00 2/207 |
| 3,618,140 | A | * | 11/1971 | Goldfarb | A42B 1/045 2/207 |
| 3,671,977 | A | * | 6/1972 | Degnon | A42B 7/00 2/207 |
| 4,468,818 | A | * | 9/1984 | Flannery | A41D 23/00 2/173 |
| 4,613,992 | A | * | 9/1986 | Dabbieri | A41D 25/00 2/144 |
| 4,993,080 | A | * | 2/1991 | Doty | A41D 23/00 2/181 |
| 5,414,869 | A | * | 5/1995 | Thomson | A41D 23/00 2/207 |

(Continued)

OTHER PUBLICATIONS

Gaga Silk Scarf, D.U.R.A. Web. 24 Mar. 24, 2017. Retrieved from Google, Originally posted Jun. 4, 2014. http://www.durathelabel.com/product/pre-order-gaga-silk-scarf.*

(Continued)

*Primary Examiner* — Richale Quinn
*Assistant Examiner* — Anne Kozak

(57) ABSTRACT

A headscarf with a medial headband that can be secured on a user's head in a variety of ways. The integrated headband allows for easy wearing, and prevents the headscarf from falling off the user's head. In addition to the headscarf being worn on one's head, it has a number of other useful applications.

2 Claims, 2 Drawing Sheets

(56) References Cited

U.S. PATENT DOCUMENTS

| | | | | |
|---|---|---|---|---|
| 5,867,835 | A * | 2/1999 | Dabbieri | A42C 5/00 2/171 |
| 6,032,292 | A * | 3/2000 | Wood | A41D 23/00 2/206 |
| 6,319,090 | B1 * | 11/2001 | Gross | A42B 1/006 2/171 |
| D582,635 | S | 12/2008 | Halley-Schamp | |
| 7,707,656 | B2 | 5/2010 | Beausang | |
| 8,185,972 | B2 | 5/2012 | Beausang | |
| 8,516,619 | B2 | 8/2013 | Absi et al. | |
| 9,241,523 | B2 * | 1/2016 | Hendricks | A41D 23/00 |
| 2007/0094768 | A1 * | 5/2007 | Moudgill | A42B 1/041 2/171 |
| 2008/0148466 | A1 * | 6/2008 | Wohl | A42B 1/062 2/209.3 |
| 2008/0295221 | A1 * | 12/2008 | Grey | A41D 23/00 2/174 |
| 2009/0000011 | A1 | 1/2009 | Halley | |
| 2012/0199505 | A1 * | 8/2012 | Black | A45D 8/00 206/278 |
| 2012/0210492 | A1 * | 8/2012 | Bielobocky | A41D 23/00 2/207 |
| 2012/0216333 | A1 * | 8/2012 | Dewese | A41D 23/00 2/207 |
| 2015/0164162 | A1 * | 6/2015 | Tran | A41D 15/00 2/69 |

OTHER PUBLICATIONS www.attachnwrap.com.

* cited by examiner

HEADSCARF WITH INTEGRATED HEADBAND

CROSS-REFERENCE TO RELATED APPLICATION

This application claims priority to U.S. Provisional Application No. 62/044,278 filed Aug. 31, 2014, entitled, "HEADSCARF WITH INTEGRATED HEADBAND," which is hereby incorporated by reference in its entirety.

BACKGROUND OF THE INVENTION

The present invention relates generally to headscarves, and more particularly, but not by way of limitation, to a headscarf with an integrated headband made to cover a wearer's head.

Headscarves have been in use throughout time as witnessed by references from religious texts and other historical accounts. Headscarves have been and are still worn for a variety of purposes, including warmth, hygiene, fashion, religious affiliation, to cover baldness, to protect the wearer from damaging ultraviolet radiation from the sun, and for social and cultural significance.

In addition to the aforementioned uses, individuals who are bald or are suffering from hair loss are increasingly using headscarves. Reasons include medical hair loss from treatments such as chemotherapy, which is on the rise as the worldwide incidence of cancer increases. In addition, there are autoimmune diseases such as alopecia, which cause baldness. Moreover, more people are using headscarves while riding motorcycles, driving convertibles, and pursuing outdoor activities, which require protection from the sun.

Standard headscarves have many common problems. For example, standard scarves are often made of smooth, soft fabrics, such as silk, polyester, jersey, for example, so that they feel comfortable next to the wearer's head. However, because these fabrics are smooth and, therefore, lack texture, they can easily slip off the wearer's head, which can cause the wearer inconvenience, embarrassment, damaged hair, or the like. This is a particular concern for those who suffer from medical hair loss or wear headscarves for religious purposes.

One solution to keeping headscarves in place is with the use of pins and/or clips. However, these pins and/or clips are cumbersome and can cause pain to the user when they rub on the user's head. Also, these pins and/or clips can cause damage to the fabric of the scarf.

Another solution to problems associated with a standard scarf is to pre-tie one or more components of the scarf to help keep the scarf secure on the user's head. However, this limits the wearer's ability to style the scarf in a manner best suited or desired by the wearer.

Wigs offer another solution to cover one's head, but they can be uncomfortable and hot as they are oftentimes made of synthetic materials. Those that are made from non-synthetic materials are oftentimes expensive and result in an unnatural appearance.

One head covering is shown in U.S. Pat. No. 2,574,208, which is hereby incorporated by reference in its entirety. This head covering is a combined headband and scarf, wherein the headband is provided with fasteners to be secured around a user's head. Moreover, the headband is placed at nearer to one corner to create unequal (smaller and larger) triangular sections to cause the scarf to fall in a particular pattern. As such, the styles that a wearer can create using this head covering is limited.

Another head covering is shown in U.S. Patent Application Publication No. 2009/0000011, which is also hereby incorporated by reference in its entirety. This head scarf contains a headband provided closer to one corner of the headband, to create a large main sheet and short sheet portions. Again, a disadvantage of this scarf is that the headband allows only for particular configurations to be created by the user and requires fastening means to be used to secure the headscarf over the user's head.

While these headscarves partially address the problem of securing the headscarf on a user's head, these headscarves do not allow for easy manipulation of the headscarf to create different styles in accordance with the purpose and desire of a user.

SUMMARY OF THE INVENTION

In accordance with the present invention, various embodiments of a headscarf with integrated headband are disclosed. In various embodiments, not limited to any particular design, the present disclosure provides for a headscarf that is equipped with a medially aligned headband intended to securely cover the head in a variety of arrangements or configurations.

In this respect, among others, the headscarf according to various aspects of the present invention departs from the conventional designs. In doing so, it provides a ready-to-wear, one-size-fits-all, headscarf for the purpose of covering the head in a variety of settings and plurality of styles. This is accomplished, in accordance with the present invention, for example, by stitching the headband in a center area of the square-shaped fabric. The resulting configuration enables the headscarf to form two right triangles when the headband is placed on the forehead, culminating in two points of fabric suspended on each side of the headband. This establishes a secure fit over the user's head while allowing the user to create a plurality of styles.

The above summary is not intended to represent each embodiment or every aspect of the present invention. Particular embodiments may include one, some, or none of the listed advantages.

DETAILED DESCRIPTION OF THE DRAWINGS

Figure 1:
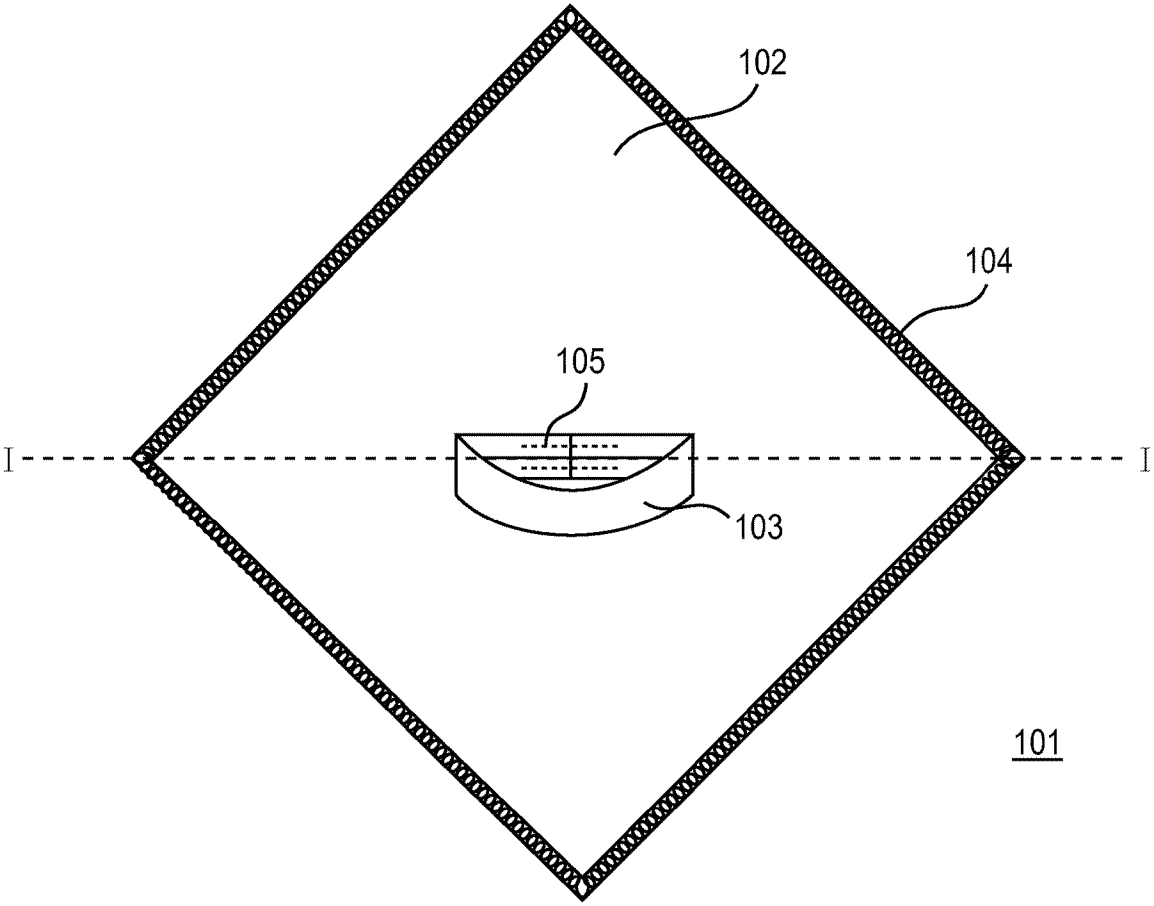
FIG. 1 illustrates the headscarf in accordance with the present invention.

Turning now to the figures, FIG. 1A illustrates headscarf 101 in accordance with one aspect of the present invention. The headscarf 101 generally comprises a single piece of fabric or material 102. An exemplary dimension for the fabric or material 102 is 48" by 48", but is not limited to such and can be a variety of other sizes. Fabric or material 102 is generally square, i.e., measuring the same length on all four sides, such that when the headscarf 101 is placed on a user's head and fabric 102 drapes or folds over itself, right angles are formed.

In the center of fabric or material 102 is headband 103. Headband 103 can also be made of fabric, which fabric is preferably elastic to accommodate users having different-sized heads and can be easily slipped over the user's head. Headband 103 can be sewn or stitched onto fabric or material 102 to create seams 105. Seams 105 are placed generally along or parallel to and around an imaginary line (shown as I-I in FIG. 1) formed by connecting two opposing corner edges 106 of fabric or material 102. This allows fabric or material 102 to drape over a user's head as right triangles when the headband 103 is positioned on the user's head. An exemplary dimension for headband is 9" by 7" fabric, which is folded in both directions to make a 8.8" by 3" finished headband. The headband can be made of an expandable or elastic fabric and can be sized to fit smaller and bigger heads. Headband 103 can also be an open loop instead of a closed loop so that it can be tied around the head of a user instead of being slipped around the head. In this embodiment, exemplary dimensions would be 43" long and 3" wide.

The trim or edge 104 can be finished or unfinished. Finished edges could include, for example, baby merrow stitching, straight stitch, zig zag edge, clean finish edge, French seam, mock French seam, bound seam, double fold bias tape, pinked, turned under seam, serged seam, bound edge, Hong Kong, hand overcast, and/or the lovely overlock machine/serger.

Various configurations and styles can be created with headscarf 101 by placing the headband in a particular orientation or manner on a user's head. For example, the headband 101 can be placed and rotated so that the fabric drapes in the back, front, or side of the user's head. This allows for various styles to be created by the user. The circular, elastic, expandable headband allows for the user to easily rotate the headscarf 101 and position it as desired.

An exemplary headscarf can be made by topstitching the headband is to a 48" by 48" piece of fabric directly in the center placing it 24" in from the ninety-degree angle point of the square fabric. This produces the formation of the ninety-degree or right triangle when placed on the head so the user can wear the scarf as a typical headscarf. In addition, this configuration allows for faster and easier placing of the headscarf on a user's head compared to ordinary scarves ensuring a more secure fit.

The size of the headband can be varied to fit various types and sizes of users/user heads. For example, if the headscarf were to be worn by an infant or child, the headband could be sized accordingly to fit the infant or child's head. Similarly, the headscarf can be of different sizes to fit varying sizes of heads, (infant, child, male, female sizes) without departing from the general scope of the present invention.

Figure 2:
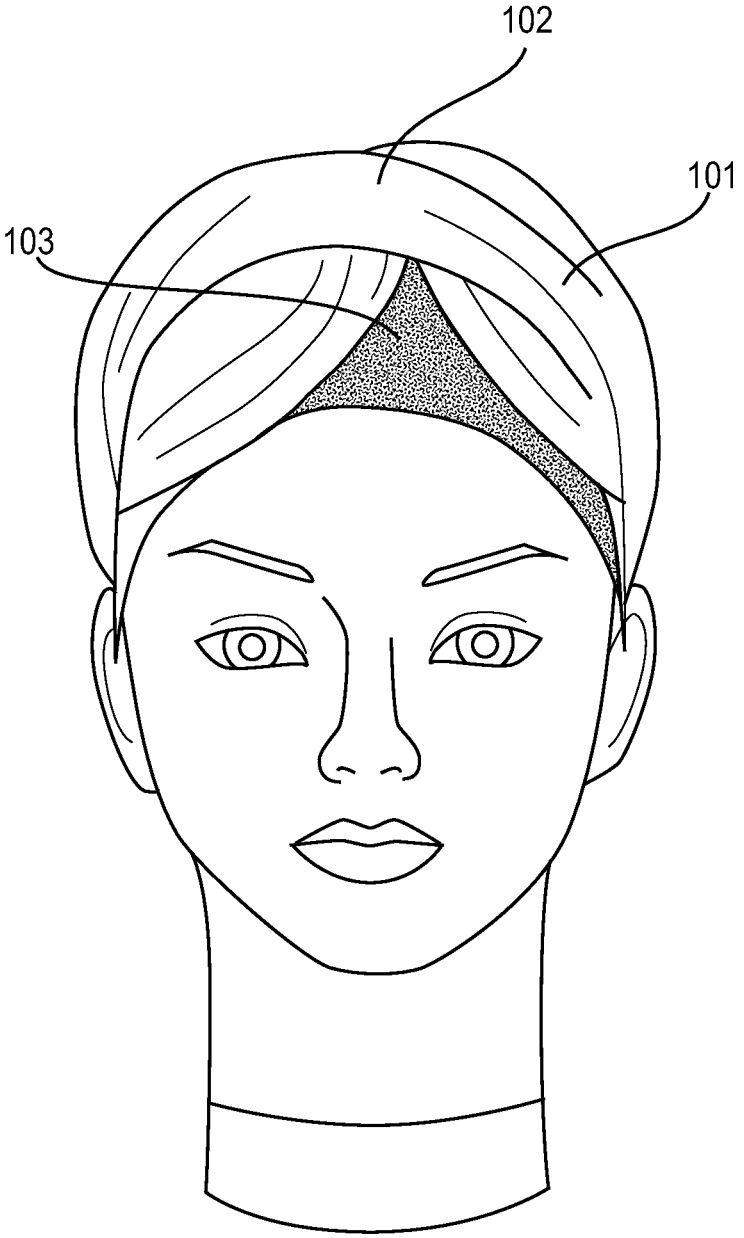
FIG. 2 illustrates the headscarf in accordance with the present invention worn by a user in one way.

FIG. 2 shows headscarf 101 worn on a user's head. In this particular example, the headscarf 101 is placed with the user's head with the fabric 102 hanging behind the user as headband 103 is visible in the front. The user is able to wrap the fabric around the head and tuck it into headband 103 to secure the headscarf 101 and prevent it from slipping or falling off. Various other styles can be created as chosen by the user/wearer, for example, a high or low bun, braid, twist, turban, loose ponytail, loosely-tied, or hijab styles, to name a few.

The headscarf can be made in a variety of colors and patterned fabrics. In addition, the headscarf can be formed from various materials such as, but not limited to, silk, cotton, polyester, pashmina, alpaca, cashmere, jersey, linen, satin, wool and any other materials, and any combination thereof. In addition, the headband provides multiple ways for the scarf to be worn beyond serving as a protective and fashionable garment, which include, for example: 1) protective coverings for the head including the medical loss of hair seen in chemotherapy patients and conditions such as alopecia; 2) a screen for nursing mothers; 3) securing an ice pack on the head or neck as a result of injury or overheating; 4) as a headpiece to be worn during exercise to protect hair; 5) as a headpiece to be worn during sleep to protect the hair; 6) as a headpiece to be worn for purposes of fashion; 7) as a headpiece to be worn for religious purposes; 8) as a scarf that can be worn for fashion or warmth; or (9) as a blouse where the headband is slipped around the user's neck and styled around the body.

While the foregoing written description of the invention enables one of ordinary skill in the art to make and use the invention, those of ordinary skill in the art will understand and appreciate the existence of variations, combination, and equivalents of the embodiments, methods, and examples provided herein. The invention should, therefore, not be limited by the embodiments and examples disclosed here, but by all embodiments and methods within the scope and spirit of the invention as claimed.

The invention claimed is:

1. A headscarf comprising:

a square piece of fabric having two sets of opposing corners;

a first axis defined between one set of opposing corners, and a second axis perpendicular to said first axis;

said first axis having a center portion, right portion and left portion, wherein each of said center, right and left portions extend along one third of a length of said first axis; and an elastic headband comprising a single piece of fabric material forming a loop, secured along said center portion of said first axis defined between one set of opposing corners creating a seam;

wherein said seam has a center through which said second axis extends;

wherein said right and left portions are free of the elastic headband;

wherein, when the elastic headband is placed over a user's head, the square piece of fabric creates overlapping right triangles.

2. A headscarf comprising:

a square piece of fabric having two sets of opposing corners;

a first axis defined between one set of opposing corners, and a second axis perpendicular to said first axis;

said first axis having a center portion, right portion and left portion, wherein each of said center, right and left portions extend along one third of a length of said first axis; and an elastic headband comprising a single piece of fabric material forming a loop, secured along said center portion of said first axis defined between one set of opposing corners creating two seams parallel to said first axis;

wherein said two seams each have a center through which said second axis extends;

wherein said right and left portions are free of the elastic headband;

wherein, when the elastic headband is placed over a user's head, the square piece of fabric creates overlapping right triangles.

* * * * *